United States Patent [19]

Nelson

[11] Patent Number: 4,850,593

[45] Date of Patent: Jul. 25, 1989

[54] REDUCED DRAG CLUB HEAD FOR A WOOD TYPE GOLF CLUB

[76] Inventor: Alan F. Nelson, 7777 E. Main St., Scottsdale, Ariz. 85251

[21] Appl. No.: 249,287

[22] Filed: Sep. 26, 1988

[51] Int. Cl.[4] ..... A63B 53/04

[52] U.S. Cl. ..... 273/167 E; 273/80 A; 273/167 H

[58] Field of Search ..... 273/77 R, 77 A, 167–175, 273/80 A; D21/214–220

[56] References Cited

U.S. PATENT DOCUMENTS

| | | | |
|---|---|---|---|
| 1,541,126 | 6/1925 | Dunn | 273/167 A |
| 1,555,425 | 9/1925 | McKenzie | 273/167 E |
| 2,550,846 | 5/1951 | Milligan | 273/167 E |
| 3,166,320 | 1/1965 | Onions | 273/80 C |
| 3,468,544 | 9/1969 | Antonious | 273/173 |
| 3,595,577 | 7/1971 | Hodge | 273/80 C |
| 3,625,518 | 12/1971 | Solheim | 273/175 |
| 3,810,631 | 5/1974 | Braly | 273/167 A |
| 3,976,299 | 8/1976 | Lawrence | 273/171 |
| 3,997,170 | 12/1976 | Goldberg | 273/164 |
| 4,444,392 | 8/1984 | Duclos | 273/77 A |

OTHER PUBLICATIONS

"Widen Your Arc", *Golf,* Dec. 1986, pp. 22–27, at p. 25.

"It Isn't Classic But it Works for Fuzzy", Ward, H., *Golf World,* Jun. 7, 1985, pp. 50–51.

*Primary Examiner*—Edward M. Coven

*Assistant Examiner*—S. Passaniti

*Attorney, Agent, or Firm*—M. David Shapiro

[57] ABSTRACT

The invention comprises an improvement in a golf club head of the wood type wherein a sole trough is located so that its root is essentially parallel to the face of the club head and wherein the surface of the trough is flat to convex in planes essentially parallel to the face in a plane through the root of the sole trough and concave in a planes perpendicular to the club face. The purpose of the sole trough is to reduce the cross-section of the club head in cross-sectional planes taken essentially perpendicular to the face of the club head, such cross-sections having a concave surface configuration over the most of the longer dimension of the trough.

7 Claims, 3 Drawing Sheets

REDUCED DRAG CLUB HEAD FOR A WOOD TYPE GOLF CLUB

FIELD OF THE INVENTION

The invention relates in general to an improved golf club head, and specifically to a wood style club head having an improved drag coefficient over a greater portion of the downswing.

BACKGROUND OF THE INVENTION

"Wood" style golf club heads and clubs so equipped are used for long distance driving of a golf ball and may be made of traditional wood or of metal, with brass, stainless steel and aluminum among those metals which have been used. All such clubs are commonly referred to as "woods," notwithstanding the particular material used.

When a golf club is at rest in a normal "address" position (the golfer is said to be "addressing" the ball), the industry standard for the angle between the shaft axis and the ground is in the range of from 55 to 56 degrees in the case of a driver. That angle is called the "lie" angle and is built into the club head. Because the club head sole rests relatively flat on the ground (most contemporary club heads are manufactured with a slightly convex sole) in the address position, the lie angle is also the angle between the shaft axis and an extension of a horizontal tangent to the resting sole surface in the direction of the shaft of the club.

It will be readily understood that decreasing the drag (caused by the velocity of the club head and shaft in a downswing plane) in a wood style golf club would make such a club perform better by providing a higher terminal club head velocity resulting in a corresponding increase in ball impact velocity and thus, a longer drive.

It is also known that when a wood style club is swung in the conventional why the heel of the club becomes the leading edge of the operative airfoil for approximately the first 225 degrees of the total 270 degree (approximately) club downswing. FIGS. 9A, 9B and 9C (all prior art) illustrate a typical wood golf club downswing and clearly illustrate the point. FIGS. 9A, 9B and 9C were derived from time lapse photographs and information published in two magazine articles: "Widen Your Arc," by The Editors of *GOLF*, December 1986, pp. 22–27, at p. 25, and, "It Isn't Classic But it Works for Fuzzy," by Harvie Ward, *GOLF WORLD*, June 7, 1985, pp. 50–51. *GOLF WORLD* is published by Dee Bee Publishing Company, 2100 Powers Ferry Road, Atlanta, Ga. 30339. *GOLF WORLD* has also published an undated "Famous Golf Swings Collection," which depicts a number of swing sequences of well known professional golfers, similar to the set published on Fuzzy Zeller in the June 7, 1985, issue, and referenced above.

FIG. 9A, is illustrative of a golfer holding a club at a typical downswing starting point (at the peak of the backswing), with club shaft 12 essentially parallel to the ground, and with club face 26 (the ball striking surface) essentially parallel to a downswing plane. (See, also, reference numeral 10A of FIG. 9B.) It is important to note that face 26 remains essentially parallel to the downswing plane when the club is within forty-five degrees from impact with ball 16. See, FIG. 9B, club head position shown at reference numeral 10H. Even at the club head position shown at reference numeral 10J of FIG. 9B, face 26 is still "open" (not square) with respect to ball 16. It is estimated that club head position 10J is about ten degrees from impact with ball 16. It is clear then, that at a point ten degrees before impact, club head 10 is still not quite square with ball 16.

FIG. 9C is included to show the relative position of club head 10 and ball 16 at the moment of impact, where club face 26 is finally, and preferably, fully square to the desired flight path of ball 16. This is the same position as is shown for club head 10K in FIG. 9B.

Most prior art attempts to reduce the effective cross-section of the club have approached the problem presented by drag in the last phase of the downswing; that is, the assumption is made that the club face is the leading edge of the club air foil and streamlining airfoils are designed with that goal in mind. See, for example, U.S. Pat. Nos. 1,555,425 issued to R. McKenzie; 2,550,846 issued to C. S. Milligan; 3,595,577 issued to W. R. Hodge; and 4,444,392, issued to C. R. Duclos; where streamlining is taught to reduce drag and where the assumption is made that the club face is the leading edge of the club head air foil. However, Duclos did recognize that the club head face is not the leading edge of the air foil over much of the downswing. Duclos teaches the use of a slot in the backside of the club head to reduce cross-section (and drag, in the early phases of the downswing) in a plane perpendicular to the face and he teaches the use of an internal cavity connected to that slot to provide:

"air within the cavity . . . in the quick dynamic environment of the club swing [in the final downswing phase] moves as shown . . . into what would otherwise be the base drag area . . . to reduce the base drag of the club head . . . " Col. 3, lines 7–11.

It is clear that Duclos's major theme was reduction of drag during the last few degrees of the downswing during the period of maximum velocity.

Other efforts to reduce drag, using techniques other than streamlining (in particular, reduction of cross-section), also assume that the most destructive drag occurs perpendicular to the club face. For examples of these see, U.S. Pat. Nos. 3,468,544 issued to A. J. Antonious; and 3,997,170 issued to M. B. Goldberg. In the former patent, holes are provided through the club head perpendicular to the face to provide a duct for air flow perpendicular to the club face.

Those prior art designs which provide a recess or depression in the sole area adjacent and parallel to the club face do not teach or suggest that such a recess would be effective in reducing cross-section and, in fact, such recesses as taught do not significantly reduce cross-section or provide streamlining because each of them either teaches a rather small sole trough having a flat surface or teach a sole trough having only a two dimensional curvature. For an example of the latter, see, Braly's U.S. Pat. No. 3,810,631 where such a two dimensional concave sole trough is taught for iron type clubs only.

U.S. Pat. No. 3,976,299, issued to Lawrence et al., suggests that a "wing" configuration with convex top and concave bottom surfaces may be of use in reducing air drag. However, the "foot" located perpendicular to the face of the club head below the "wing" section would appear to be oriented for best efficiency were the face of the club head to be considered the leading edge of the air foil.

The problem with most of these designs is that during the great majority of a classic golf club downswing (beginning approximately 270 degrees prior to ball contact), which begins with the club shaft parallel to the ground and extended behind the golfer's head, the leading edge of the club head airfoil is not the face, but the heel, about ninety degrees removed from the face. See, FIGS. 9A, 9B and 9C. The result is that prior art attempts to reduce drag by optimizing airfoil in a direction perpendicular to the face are ineffective over the major portion of the downswing of the club. Duclos recognized the problem and attacked it with a rear slot and connected cavity configuration.

It is also well known that concentrating the mass in a wood style club head at or behind the point of impact with the golf ball tends to increase horizontal spin on the ball, thus tending to cause hooks and slices; those curvatures in ball flight which are evidenced by the ball curving away to the left or right of the desired flight path. This is believed to be caused by the fact that the club head does not always strike the ball on its "sweet spot." When an offset impact point (offset from that "sweet spot") is encountered and mass is concentrated behind the "sweet spot," a force is created which tends to rotate the club shaft about its axis. That causes the club head to rotate so that the face is not perpendicular to a desired flight path, in turn causing a well known hook or slice. When the mass is concentrated in the extremities of the club head, rather than behind the sweet spot, moment of inertia is increased and there is much more resistance to club head 10 rotation upon impact with ball 16.

Hollow club heads are rather common in metallic "wood" club heads because, if metallic club heads are made solid, they become too heavy for practical use. However, hollow club heads tend to provide a "tinny" sound and feel on impact which does not appeal to some golfers. Furthermore, if the face of a hollow head club is made too thin, it may deform on impact because of the tremendous impact loads. The enclosed top of hollow club heads serves to reenforce the face at an upper edge thereof but the closure adds weight above the center of gravity of the club head which raises the effective center of gravity; an undesirable characteristic. The hosel area of a hollow club is another weak point because of the thin metal in which the hosel is mounted. Metal woods generally have the same shape as traditional wood drivers. It is believed that the majority of metal woods are of the hollow type.

SUMMARY OF THE INVENTION

The forgoing problems and shortcomings with prior art wood type golf club heads are resolved according to the instant invention which employs a sole trough whose root runs approximately parallel to the club face, is convex in the transverse (root line) direction and is concave in a direction perpendicular to the face of the club head. It is believed that downswing acceleration is more difficult to attain during the first part of the swing because of the requirement to overcome the high inertia of the zero velocity club at the beginning of the downswing. That is, it is believed that it takes more energy to overcome inertia and drag at the beginning of the downswing than at the point of contact even though it is recognized that there is a much higher drag force exerted at the end of the downswing because of the higher velocity at that time. However, it is believed that inertia is an aiding force rather than a hindering force just before club head/ball impact and that it is, on balance, more important to reduce drag in the early phase of the downswing in order to allow acceleration to a higher impact velocity at the moment of club head/ball impact.

Because the club head is presented to the air flow heel-first over the great majority of a classic golf downswing, the club head of the invention is designed to minimize the club head cross section and air drag when exposed to the air flow caused by approximately the first 225 degrees of a normal downswing portion of a golfer's stroke. Furthermore, the troughlike shape is created in the sole area of a conventional club head. The surface of that trough is convex in vertical planes essentially parallel to the face of the club and is mostly concave in a series of cross-sectional vertical planes which are taken perpendicular to the face of the club head. These unique shapes are believed to reduce drag of the club head over at least 225 degrees of downswing by reducing the effective cross-sectional area perpendicular to the club head path and by presenting a more efficient airfoil to the air flow over about 225 degrees of the downswing.

It is therefore, an object of the invention to reduce the drag coefficient of a wood style golf club head during more than the first eighty percent of the downswing by reducing the cross-section of the club head in the vertical planes which lie perpendicular to the club head face.

It is another object of the invention to provide a complex surface curvature in a sole trough of a golf club head to improve the airfoil of the club head during more than the first eighty percent of the downswing.

It is still another object of the invention to maintain a relatively low center of gravity in the club head.

It is yet another object of the invention to provide a sole trough being convex in a vertical plane through a root line and having a family of convex surfaces in vertical planes parallel to the root line plane while demonstrating a concave configuration in vertical planes perpendicular to the club head face.

It is one more object of the invention to distribute the mass in the club head in a relatively wide configuration relative to the width (in the heel-toe direction) of the club face.

These and other objects of the invention will become more apparent upon review of the Detailed Description of the Invention, below, taken together with the drawings in which:

FIG. 9 is an artist's reproduction of prior art photographs illustrative of a series of traditional golf club and club head positions as a classic downswing is executed by a professional golfer showing the position of the club head with respect to direction of travel at each of eleven positions in the downswing;

DETAILED DESCRIPTION OF THE PREFERRED EMBODIMENT OF THE INVENTION (In the various Figures, identical reference numerals are used to identify identical features.)

Figure 1:
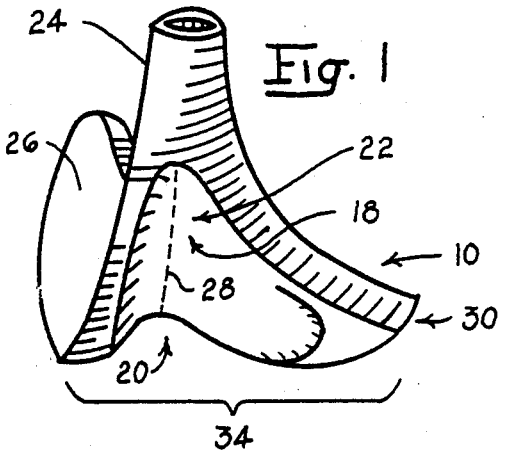
FIG. 1 illustrates a view looking at the heel of the club head of the invention and showing the entry portion of the trough of the invention as viewed from the heel of the club head.

Looking first at FIG. 1, it may be seen that the airfoil leading edge or entry area 18 of sole trough 20 begins at heel area 22 near where hosel 24 makes a transition into heel area 22. Entry area 18 is that area of sole trough 20 which is the leading edge of the total airfoil of the club head sole 34.

Striking face 26 is essentially parallel to a root 28 (dashed line) of sole trough 20 of club head 10 of the invention. In cross sections of sole trough 20 taken perpendicular to face 26, sole trough 20 has a concave surface over most of its width, but which may flatten somewhat at each extremity; the flat cross-sections, if any, appear at the heel and toe areas of sole trough 20 and are a minor portion of sole trough 20. As will be seen, in a cross section of sole trough 20 taken in a vertical plane essentially through root 28 of sole trough 20 and essentially parallel to face 26, the surface of sole trough 20 is convex. In adjacent planes parallel to the vertical plane through root 28, the surface of sole trough 20 is also convex.

Figure 2:
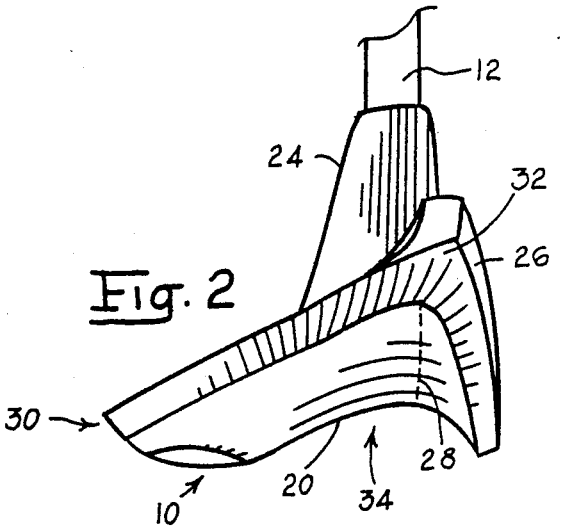
FIG. 2 is a view of the club head shown in FIG. 1 taken from the toe of the club head and showing the exit portion of the trough of the invention.

In FIG. 2 it may be seen that toe area 32 is at an extremity on an opposite end of club head 10, away from heel area 22. Sole trough 20 extends through sole 34 from heel 22 to toe 32 and has a convex surface along the root 28 of sole trough 20. It will also be noted that cross sections taken in vertical planes perpendicular to face 26 the surfaces are concave. Although sole trough 20 preferably is widened at toe end 32 of club head 10, other configurations may be just as effective.

Figure 3:
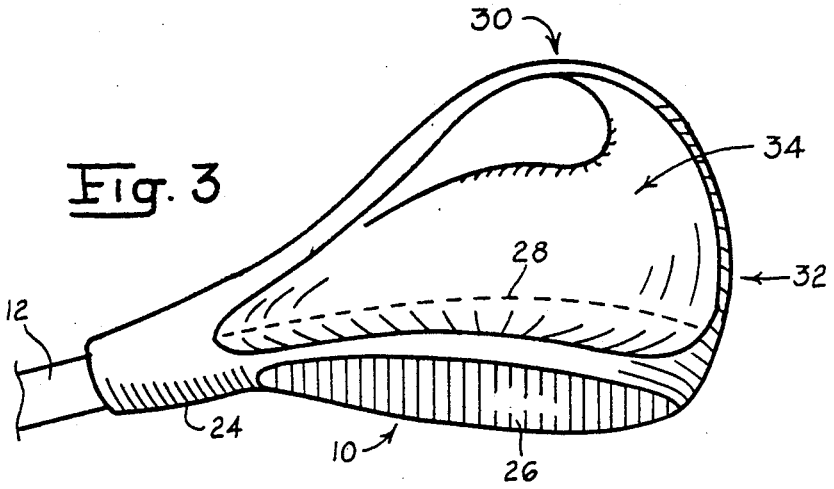
FIG. 3 is a view of the sole of the club head of the invention of FIG. 1 as it appears from the bottom of the club head.

FIG. 3 shows sole trough 20 of the invention in a view taken from the bottom 34 of the club. The dashed line lies along the root line 28 of sole trough 20 and defines a convex surface along the root line 28. Root line 28 also defines a root line plane (not shown). Other planes, parallel and adjacent the root line plane would also reveal a convex surface which extends out to either extremity of sole trough 20.

Figure 4:
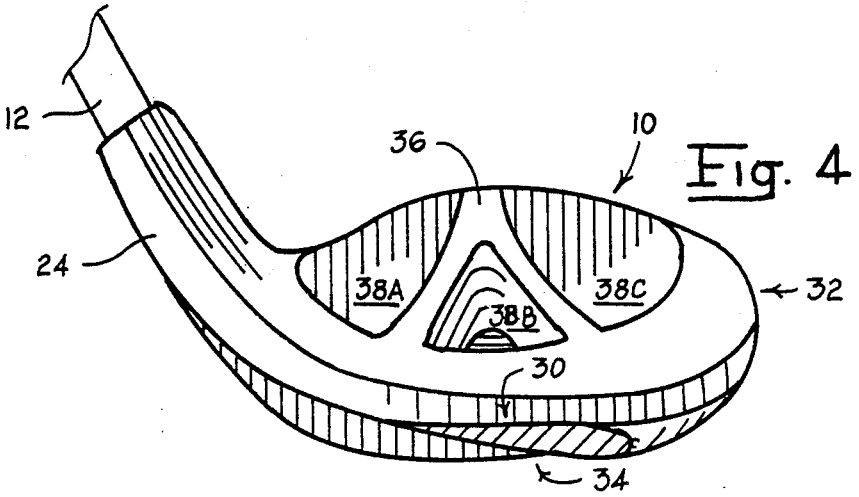
FIG. 4 is a view of the back of the club head of the invention of FIG. 1 as viewed from the back of the club head.

FIG. 4 is illustrative of a rear view of club head 10, taken from the back 30. A partial view of the top of club head 10 is revealed and shows a "V" shaped reenforcing structure 36. The apex of the "V" terminates on a back (inside) surface of the face/ball contact area. The volume in the interstitial areas in and about "V" section 36 is hollowed out to reduce weight in the central portion of club head 10. The deep "V" shape web 36 extends to the bottom and to the back of the hollowed out portion and divides it into three hollows 38A, 38B and 38C. This is believed to provide maximum reenforcing of the ball contact area of face 26 while assuring that club head mass is spread to the heel 22 and toe 32 areas of club head 10 to assure minimization of hook and slice forces on the golf ball when impacted by club head 10 of the invention. The "V" configuration of web 36 also aids the golfer in easy identification of the center of face 26.

Figure 5:
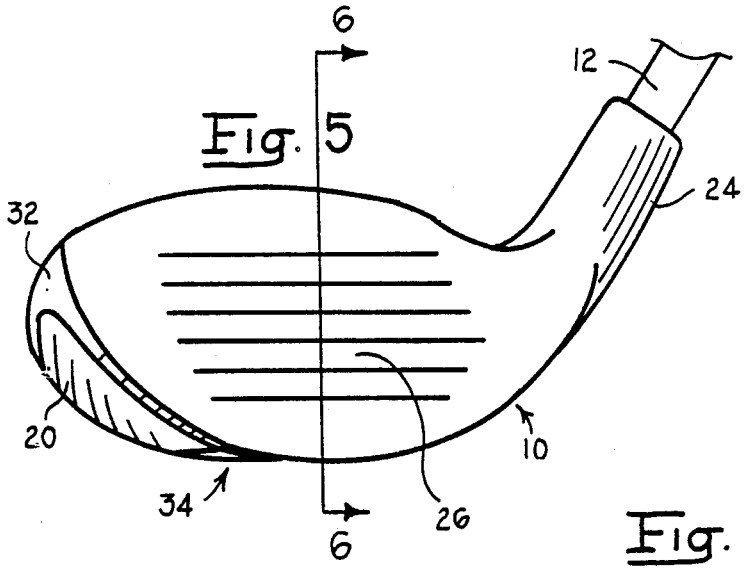
FIG. 5 is a view of the face of the club head of the invention of FIG. 1.

FIG. 5 is a view of the face 26 of the club head 10 of the invention and illustrates a conventional grooved face 26 feature.

Figure 6:
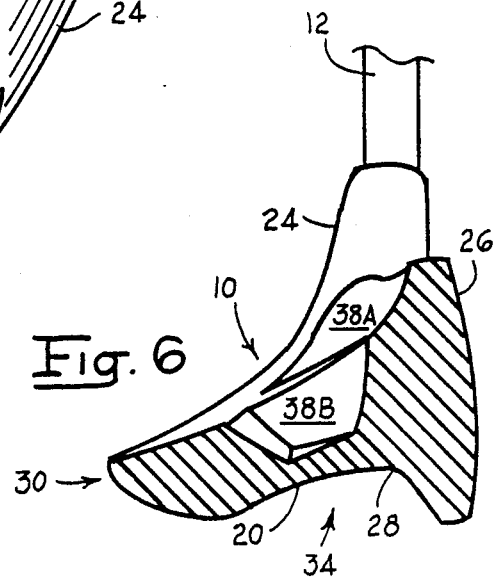
FIG. 6 is a view of the cross section 6—6 of FIG. 5.

A cross section taken at 6—6 of FIG. 5 appears in FIG. 6. There it may be seen that sole trough 20 in sole 34 is concave in the plane of the cross section.

Figure 7:
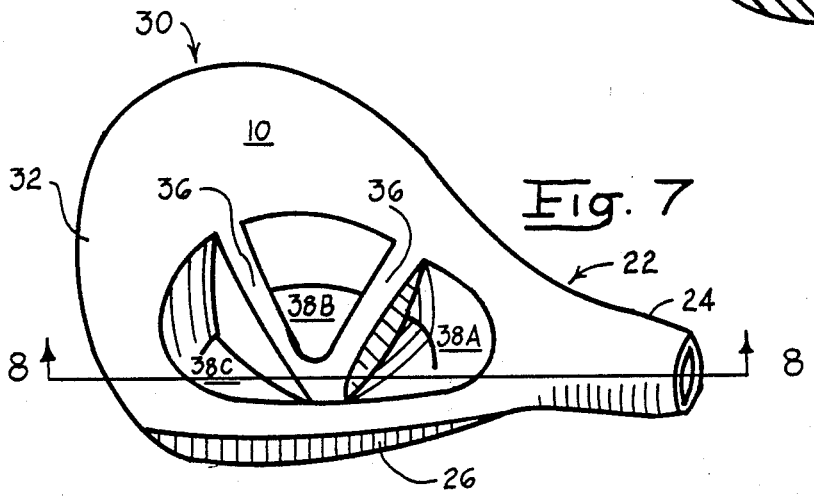
FIG. 7 is a view of the top of the club head of the invention of FIG. 1 showing a preferred face reenforcing pattern.

FIG. 7 is a top view of the club head 10 of the invention, again showing the recesses 38A, 38B and 38C in top of the club head 10 defined by "V" reenforcing section 36 and surrounding portions of club head 10. In this view it may be seen that toe area 32 extends transversely further than face 26 which has the effect of placing more of the club head 10 mass further away from the central portion of club head 10; see reference numeral 32A. This design allows a lighter metal material to be used (lighter than the brass and steel materials sometimes used), by providing relatively massive volumes of material placed well away from the central portions of club head 10. Aluminum alloy type 356-T6 has been used in casting the prototype club head of the invention with excellent results. It is believed that other materials may be employed with similar results.

Figure 8:
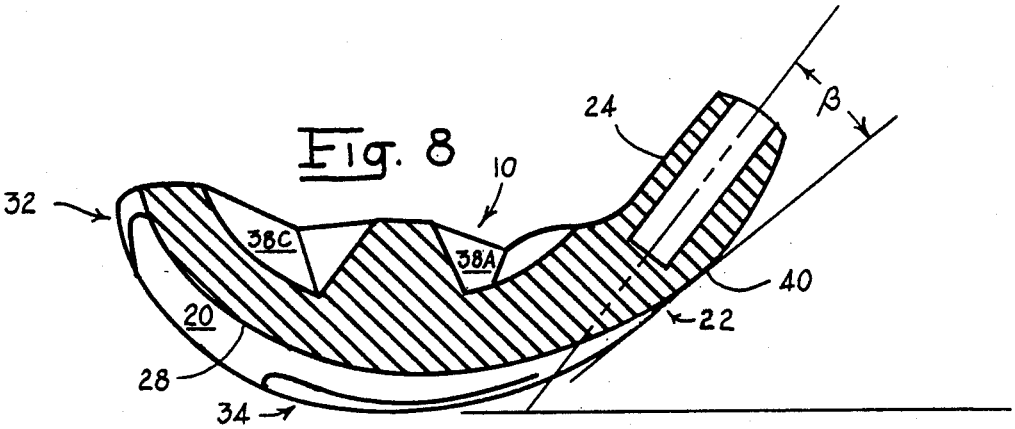
FIG. 8 is a view of the cross section 8—8 of FIG. 7.
Figure 9A:
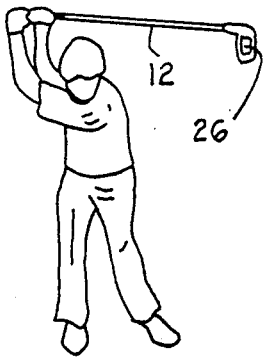
Fig. 9A (PRIOR ART)
FIG. 9A illustrates a classic golf downswing beginning at the end of the backswing.
Figure 9A:
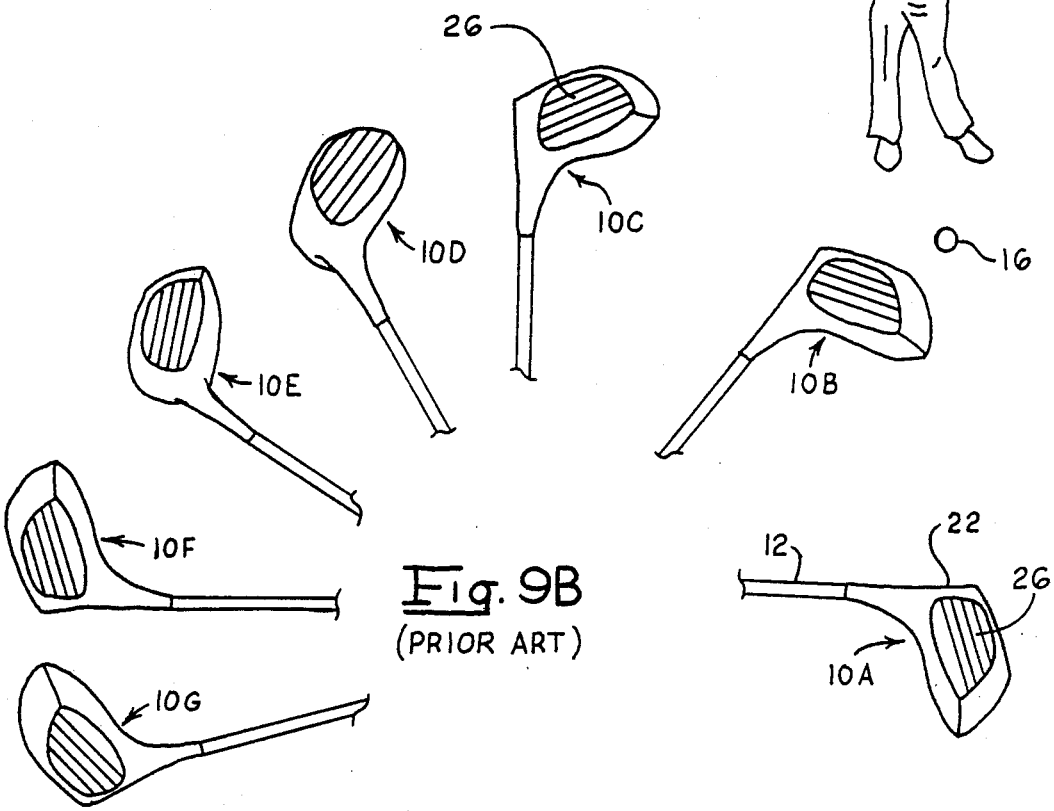
Fig. 9A (PRIOR ART)
Figure 9B:
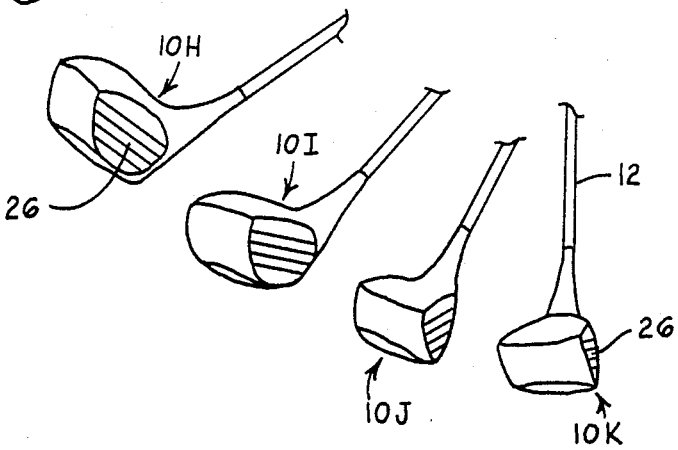
Fig. 9B (PRIOR ART)
FIG. 9B illustrates the position of the club head and a portion of the club shaft at eleven selected positions in the down swing.
Figure 9C:
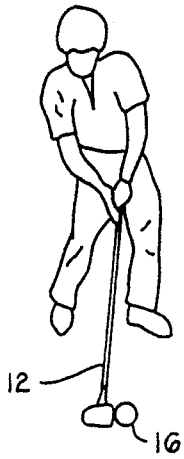
Fig. 9C (PRIOR ART)
FIG. 9C illustrates the downswing at the point of ball impact.

FIG. 8 is a cross section of club head 10 taken at 8—8 of FIG. 7. This section is in a nearly vertical plane through root 28 of sole trough 20 of the invention. It may be seen that sole trough 20 ends in toe area 32 and in heel area 18 and that root 28 extends through the entire sole trough 20, from one end to the other. Here, it is clear that root 28 has a convex surface in the vertical plane of the cross section 8—8. At what becomes the leading edge 40 of the airfoil of club head 10 over about the first 225 degrees of a conventional club downswing, the angle between the entry tangent to root 28, at leading edge 40, is approximately eleven degrees with respect to the shaft axis 42, as shown at $\beta$, FIG. 8. While a $\beta$ equal to about 11 degrees has demonstrated marked improvement in terms of reduced drag in the club head of the invention, it is believed that other angles, $\beta$, in the range of from 0–45 degrees, are also beneficial. The smooth convex curvature of root 28 is also believed to contribute to lower drag across sole 34 of club head 10.

Because sole trough 20 has a root 28 surface which is convex and other surfaces of sole trough 20 in planes parallel and immediately adjacent the plane through root 28, are also convex and because the entry angle, $\beta$, is preferably nearly tangent to shaft axis 42, the airfoil of sole trough 20 is believed to reduce the drag of club head 10 by providing an air flow over and through sole trough 20 area of club head 10 by maintaining laminar flow over a greater longitudinal distance from heel 22 to toe 32. The smaller cross-section of club head 10 in planes perpendicular to face 26, due to the concave cross-sections perpendicular to face 26, also is believed to reduce the drag characteristics of club head 10 over at least the first 225 degrees of the downswing.

An analysis of the motion of club head 10 in a classic downswing reveals that there is a significant motion vector of club shaft 12 parallel with its own axis. This motion vector is derived from an unusual and complex action caused by the golfer's arm linkage and wrist motion.

Although it may at first seem reasonable that all streamlining of club head 10 should assume a shaft motion perpendicular to air flow, that is clearly not the case. The shaft axis parallel motion vector of club shaft 12 indicates that the leading edge of the club head airfoil should be assumed at some angle between parallel and perpendicular to club shaft 12. It is suggested that an air flow angle between zero and forty-five degrees from shaft axis 12 is preferred for optimum air flow over the leading edge foil and the foil should be designed to accommodate such flow angles.

While the invention has been particularly shown and described herein with reference to a preferred embodiment thereof, it will be understood by those skilled in the art that various other modifications and changes may be made to the present invention from the principles of the invention as herein described without departing from the spirit and scope as encompassed in the accompanying claims. For example, but without limitation, the club head may be made of any of a number of different acceptable materials, the hollows in the top of the club head may take any of a wide variety of configurations or may be closed to comprise a hollow club head, as is well known in the prior art, and the hosel design may be adapted to a number of different shaft materials and designs. The sole trough design, as herein described for wood style golf clubs may also be of some value when applied to other styles of golf clubs. Streamlining of club head 10 may assume air flow angles of from zero to forty-five degrees with respect to the longitudinal axis of club shaft 12. Therefore, it is intended in the appended claims to cover all such equivalent variations which may come within the scope of the invention as described.

What is claimed is:

1. In a golf club having a club head and a shaft, the club head having a back portion, a face, a heel portion, a toe portion, a sole portion, a top portion, and a hosel portion for accepting a proximal end of the shaft, wherein the hosel portion is an extension of the heel portion, the improvement comprising:

a sole trough, said sole trough having a root line, said root line running substantially from the hosel portion extension of the heel portion to the toe portion of the club head, said sole trough being a depression in the heel, the toe and the sole portions of the club head, wherein a vertical section taken parallel to and along said root line of said sole trough has a convex surface shape.

2. The improved golf club head according to claim 1 wherein a vertical section taken perpendicular to said root line of said sole trough has a concave surface shape.

3. The improved golf club head according to claim 1 wherein said root line of said sole trough has an entry tangent at a heel portion of said sole trough which forms an angle with respect to a long axis of the shaft of the golf club, said angle being no greater than forty-five degrees.

4. The improved golf club head according to claim 1 wherein a center of gravity of said club head is moved toward an area where the back portion and the toe portion of said club head merge together.

5. The improved golf club head according to claim 1 wherein a portion of the top of the club head is hollowed out behind the club head face.

6. The improved golf club head according to claim 5 wherein said hollowed out portion is reenforced by at least one web located therein.

7. The improved golf club head according to claim 5 wherein said at least one web comprises a V shaped web with an apex of said V shaped web abutting an after surface of the face portion.

* * * * *

US004850593B1

REEXAMINATION CERTIFICATE (3073rd)

United States Patent [19] [11] B1 4,850,593

Nelson [45] Certificate Issued Dec. 10, 1996

[54] REDUCED DRAG CLUB HEAD FOR A WOOD TYPE GOLF CLUB

[76] Inventor: Alan F. Nelson, 7777 E. Main St., Scottsdale, Ariz. 85251

Reexamination Request:
No. 90/004,078, Jan. 5, 1996

Reexamination Certificate for:

| | |
|---|---|
| Patent No.: | **4,850,593** |
| Issued: | **Jul. 25, 1989** |
| Appl. No.: | **249,287** |
| Filed: | **Sep. 26, 1988** |

[51] Int. Cl.[6] ..... A63B 53/04
[52] U.S. Cl. ..... 473/328; 473/345; 473/346
[58] Field of Search ..... 473/324, 325, 473/326, 327, 328, 332, 334–339, 333, 340, 341, 345, 349, 350, 282, 291, 228, 346

[56] References Cited

U.S. PATENT DOCUMENTS

| | | |
|---|---|---|
| 1,514,126 | 6/1925 | Dunn . |
| 3,166,320 | 1/1965 | Onions . |
| 3,625,518 | 12/1971 | Solheim . |
| 4,602,787 | 7/1986 | Sugioka et al. . |
| 4,681,321 | 7/1987 | Chen et al. . |
| 4,754,974 | 7/1988 | Kobayashi . |

FOREIGN PATENT DOCUMENTS

| | | |
|---|---|---|
| 38-2829 | 2/1963 | Japan . |
| 52-538 | 5/1977 | Japan . |

OTHER PUBLICATIONS

"Tiger Shark" Catalog; 1986; illustration of the Tiger Shark, Piranha, and Sand Shark club models.
"Tiger Shark" Catalog; published 1987, illustrating the Great White, Tiger Shark, Piranha, and Sand Shark models.
"Tiger Shark" Advertisement; Golf Digest, Nov. 1985.
"Tiger Shark" Advertisement; Golf Digest, Jun. 1985, p. 118.
Dynacraft, 1987 Golf Products Catalog; Tour Models 484 and 440.
"Golf Digest", p. 28, Jun. 1985; Silver lynx Model.
MacGregor Golf History–Catalogs, published 1980, showing the 152 T, REC, M85T, MT1, ST3 and TR3A models.
"Classic Golf Clubs", published Dec. 1985, MacGregor Tourney 3852MS model, p. 162.
"Golf Equipment Universal '85", published Mar. 1, 1985, showing the Silver Lynx and Lion Bantamlite models.
"Golf Equipment Universal '84", published Mar. 1, 1984, showing the Piranha model.

*Primary Examiner*—Sebastiano Passaniti

[57] ABSTRACT

The invention comprises an improvement in a golf club head of the wood type wherein a sole trough is located so that its root is essentially parallel to the face of the club head and wherein the surface of the trough is flat to convex in planes essentially parallel to the face in a plane through the root of the sole trough and concave in a planes perpendicular to the club face. The purpose of the sole trough is to reduce the cross-section of the club head in cross-sectional planes taken essentially perpendicular to the face of the club head, such cross-sections having a concave surface configuration over the most of the longer dimension of the trough.

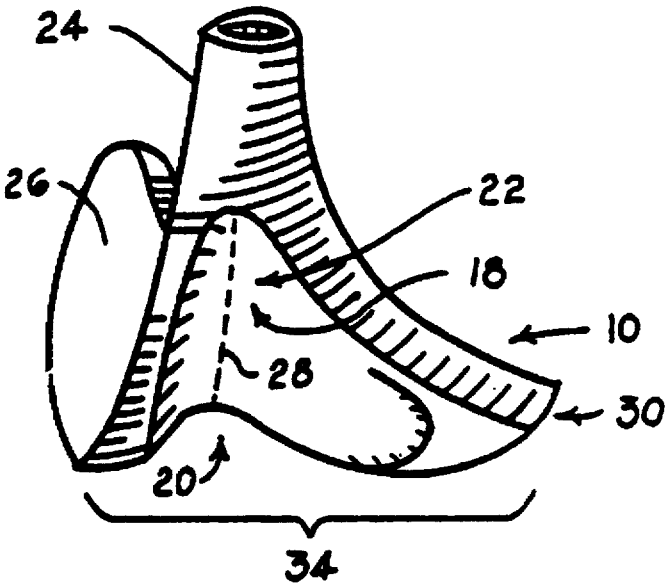

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS BEEN DETERMINED THAT:

The patentability of claims 1–7 is confirmed.

* * * * *